United States Patent [19]

Hennings et al.

[11] Patent Number: 5,008,646

[45] Date of Patent: Apr. 16, 1991

[54] NON-LINEAR VOLTAGE-DEPENDENT RESISTOR

[75] Inventors: Detlev Hennings, Aachen; Bernd F. W. Hoffmann, Rheinstetten; Markus Nutto, Endingen, all of Fed. Rep. of Germany

[73] Assignee: U.S. Philips Corporation, New York, N.Y.

[21] Appl. No.: 371,866

[22] Filed: Jun. 26, 1989

[30] Foreign Application Priority Data

Jul. 13, 1988 [DE] Fed. Rep. of Germany ..... 3823698

[51] Int. Cl.[5] ..... H01C 7/10

[52] U.S. Cl. ..... 338/20; 338/21; 252/518

[58] Field of Search ..... 338/20, 21; 252/518, 252/519, 520, 521

[56] References Cited

U.S. PATENT DOCUMENTS 4,160,748 7/1979 Yodogawa et al. ..... 252/518

4,400,683 8/1988 Eda et al. ..... 338/21

4,908,597 3/1990 Sutton et al. ..... 338/21

*Primary Examiner*—Bruce A. Reynolds

*Assistant Examiner*—Marvin M. Lateef

*Attorney, Agent, or Firm*—Norman N. Spain

[57] ABSTRACT

Non-linear voltage-dependent resistor having a ceramic sintered body based on zinc oxide as a resistance material which is doped with at least one alkaline earth metal, rare earth metal and metal of the iron group present as an oxide and is doped with at least one of the metals from the group aluminum, gallium and/or indium and having electrodes provided on oppositely located major surfaces of the sintered body, in which the sintered body is constructed from several layers having at least a layer structure of one layer of resistance material on a carrier layer based on zinc oxide which has a higher electric conductivity as compared with the resistance material, as well as a method of manufacturing same.

19 Claims, 1 Drawing Sheet

NON-LINEAR VOLTAGE-DEPENDENT RESISTOR

BACKGROUND OF THE INVENTION

The invention relates to a non-linear voltage-dependent resistor having a ceramic sintered body based on zinc oxide as a resistance material which is doped with at least one alkaline earth metal, at least one rare earth metal and at least one metal of the iron group present as oxides and with at least one of the metals of the group aluminum, gallium and/or indium and electrodes provided on the oppositely located major surfaces of the sintered body. The invention also relates to a method of manufacturing such a resistor.

Non-linear voltage-dependent resistors (hereinafter also referred to as varistors) are resistors the electric resistance of which at constant temperature above a threshold voltage $U_A$ decreases very considerably with increasing voltage. This behaviour may be described approximately by the following formula:

$$I=(V/C)^{\alpha}$$

wherein:

I=current through the varistor

V=voltage drop at the varistor

C=geometry-dependent constant; it indicates the ratio voltage/(current)$^{1/\alpha}$.

In practical cases this ratio may take a value between 15 and a few thousands.

$\alpha$=current index, non-linearity factor or control factor; it depends on the material and is a measure of the slope of the current-voltage characteristic; typical values are in the range from 30 to 80.

Varistors are frequently used for the protection of electrical devices, apparatuses and expensive components from excess voltage and voltage peaks. The operating voltages of varistors are in the order of magnitude from 3 V to 3000 V. For the protection of sensitive electronic components, for example integrated circuits, diodes or transistors, low-voltage varistors are increasingly required, the operating voltages $U_A$ of which lie below approximately 30 V and which show as high values as possible for the coefficient of non-linearity $\alpha$. The higher the value for the coefficient of non-linearity $\alpha$, the better is the operation as an excess voltage limiter and the smaller is the power consumption of the varistor. Varistors based on zinc oxide show comparatively good efficients of non-linearity $\alpha$ in the range from 20 to 60.

Varistors based on zinc oxide and having approximately 3 to 10 mol. % metal oxide additions, for example, MgO, CaO, $La_2O_3$, $Pr_2O_3$, $Cr_2O_3$, $Co_3O_4$ as a dopant are known (for example, from DE 29 52 884, or Jap. J. Appl. Phys. 16 (1977), pp. 1361 to 1368). As a result of the doping the interior of the polycrystalline ZnO grains becomes low-ohmic and high-ohmic barriers are formed at the grain boundaries. The contact resistance between two grains is comparatively high at voltages <3.2 V but at voltages >3.2 V it decreases by several orders of magnitude when the voltage increases.

Varistors with sintered bodies based on zinc oxide doped with rare earth metal, cobalt, boron, an alkaline earth metal and with at least one of the metals of the group consisting of aluminum, gallium and/or indium are known from DE 33 23 579.

Varistors with sintered bodies based on zinc oxide doped with a rare earth metal, cobalt, an alkaline earth metal, alkali metal, chromium, boron and with at least one of the metals of the group consisting of aluminum, gallium and/or indium are known from DE 33 24 732.

Both the varistors known from DE 33 23 579 and the varistors known from DE 33 24 732 only show useful values for the non-linearity coefficient $\alpha$ at threshold voltages $U_A$ above 100 V with $\alpha>30$. At threshold voltages $U_A$ below 100 V the values for $\alpha$ with the range from 7 to 22 are too low as regards effective excess voltage limit and power input of the varistors. Moreover, a boron doping has a flux activity and leads to the formation of liquid phases in the sintered body during the sintering process, which is undesired when diffusion processes must be avoided during the sintering.

The way usually employed so far of manufacturing low-voltage varistors based on doped zinc oxide is to use coarse granular resistance material. Sintered bodies of doped zinc oxide having a comparatively coarse granular structure with grain sizes >100 μm are obtained, for example, when material of the system ZnO—$Bi_2O_3$ is doped with approximately 0.3 to approximately 1 mol. % of $TiO_2$. $TiO_2$ forms with $Bi_2O_3$ a low-melting-point eutectic when sintering which stimulates the grain growth of polycrystalline ZnO. A disadvantage, however, is that comparatively long rod-shaped ZnO crystallites are often formed which considerably impede a control of the microstructure of the ceramic structure. The grain distributions which are always very wide and nearly always inhomogeneous in a $TiO_2$-doped resistance material from the system ZnO—$Bi_2O_3$ nearly render the manufacture of varistors with reproducible operating voltage $U_A<30$ V substantially impossible.

SUMMARY OF THE INVENTION

It is the object of the invention to provide varistors and in particular low-voltage varistors which have reproducibly low values for the operating voltage $U_A$ in the range $\lesssim 30$ V besides values for the coefficient of non-linearity $\alpha>30$, as well as methods of manufacturing same.

According to the invention this object is achieved in that the sintered body is constructed from several layers having at least one laminated structure of one layer of resistance material on a carrier layer based on zinc oxide which has a higher electrical conductivity as compared with the layer of resistance material.

DETAILED DESCRIPTION OF THE INVENTION

Figure 1B:
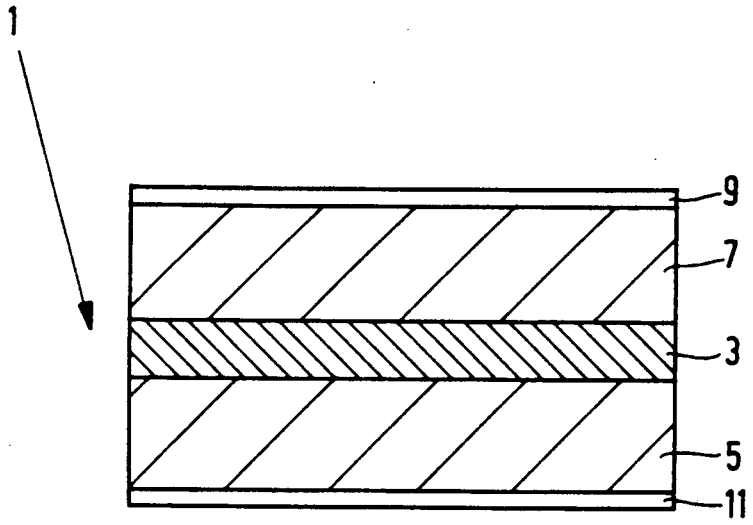
FIG. 1*b* is a cross-sectional view of an addition multi-layer varistor of the invention.

According to a preferred embodiment of the non-linear voltage-dependent resistor according to the invention a coating layer based on zinc oxide and having a higher electrical conductivity as compared with the resistance material is also provided on the layer of resistance material.

The invention is based on the recognition of the fact that the operating voltage $U_A$ in varistors based on zinc oxide with dopants forming high ohmic grain boundaries is determined substantially by the number of grain boundaries which the current I has to pass between the electrodes. When comparatively thin layers of resistance material are present the number of the grain boundaries can be kept in comparatively narrow limits. The invention is moreover on based on the recognition of the fact that in addition a particularly uniform grain growth in a comparatively thin layer of resistance material can be achieved when the layer of resistance material is coated in an as large as possible surface area by layers of a material which in the sintering process shows a similar grain growth as the resistance material but does not influence the resistance properties of the finished varistor. Non-linear voltage-dependent resistors having average operating voltages $U_A \approx 20$ V are already obtained when the varistor shows only one laminated structure of a layer of resistance material on a carrier layer. When moreover a coating layer is provided the layer of resistance material is hence coated in an even larger surface area from material of a similar sintering behaviour but a higher electrical conductivity, varistors are obtained having reproducible values for the operating voltage $U_A \leqq 10$ V with even improved values for the coefficient values of non-linearity $\alpha$.

According to advantageous embodiments of the non-linear voltage-dependent resistor according to the invention the resistance material consists of zinc oxide doped with 0.01 to 3.0 at. % praseodymium, 1.0 to 3.0 at.% cobalt, 0 to 1.0 at. % calcium and 10 to 100 ppm aluminium, preferably of zinc oxide doped with 0.5 at. % praseodymium, 2 at. % cobalt, 0.5 at. % calcium and 60 ppm aluminum.

According to further advantageous embodiments of the non-linear voltage-dependent resistor according to the invention the material for the carrier layer(s) (zinc oxide) and the coating layer is doped with 30 to 100 ppm aluminum in particular with 60 ppm aluminum. As a result of this the material for the carrier layer(s) and for the coating layer obtain a higher electrical conductivity as compared with the resistance material and on the basis of the very similar major constituent of the material for the resistance layer and for the carrier layer(s) and the coating layer (zinc oxide), respectively, a granular structure is obtained in all the layers having grains of a similar grain size.

According to further advantageous embodiments of the non-linear voltage-dependent resistor according to the invention the electrodes are provided as laminar electrodes without wire connections, preferably consisting predominantly of silver. This permits the varistors according to the invention to be used as SMD components (leadless surface mount components).

According to further advantageous embodiments of the non-linear voltage-dependent resistor according to the invention the layer(s) of resistance material has (have) a thickness in the range from 65 to 250 $\mu$m and the carrier layer(s) and the coating layer each have a thickness in the range from 250 to 600 $\mu$m.

This provides the advantage that varistors can be manufactured of comparatively small dimensions which is of importance with respect to the increasing microminiaturisation of the electronic circuits.

A method of manufacturing a non-linear voltage-dependent resistor having a ceramic sintered body based on zinc oxide as a resistance material which is doped with at least one alkaline earth metal, rare earth metal and metal of the iron group present as an oxide and is doped with at least one of the metals from the group of alumino gallium and/or indium, and having electrodes provided on the oppositely located major surfaces of the sintered body is characterized in that a multi-layer sintered body is manufactured having at least a laminated structure of one layer of resistance material on a carrier layer based on zinc oxide which has a higher electrical conductivity as compared with the resistance material.

According to an advantageous embodiment of the method according to the invention dry powder mixtures of the resistance material layer(s) of the material for the carrier layer(s) and the coating layer are manufactured and said powder mixtures are packed and deformed in a matrix under pressure in accordance with the desired layer structure and the desired layer thickness in such a manner that the powder mixtures individually are packed and deformed in layers one upon the other in accordance with the layers to be manufactured.

The layers of the powder mixtures are preferably packed at the pressure in the range from $8 \times 10^7$ to $1{,}8 \times 10^8$ Pa. It is advantageous to vary the pressure for packing the individual layers of powder mixtures from layer to layer in such a manner that the carrier layer is packed and deformed at the highest pressure, the layer of resistance material is then packed and deformed at a lower pressure and the coating layer is packed and deformed at a still lower pressure. In this manner it is ensured that comparatively sharply bounded transitions between the individual layers are obtained and that the material of the applied layer(s) is not forced into the underlying carrier layer thereby forming an undesirably deep mixed layer.

The layer structure of the varistors according to the invention can, of course, also be manufactured by means of other manufacturing processes. For example, fluid slurries of the layer material may also be used which can be moulded or layer structures can be manufactured from highly viscous masses by rolling or extrusion.

According to further advantageous embodiments of the method according to the invention the green bodies compressed from the powder mixtures may be sintered in air in the range from 1260° to 1300° C. with a heating rate of $\approx 10°$ C. per minute, the sintering of the moulded bodies being preferably controlled so that the maximum sintering temperature is maintained for from 0 to 240 minutes before the cooling process is started. The height of the sintering temperature and also the duration of the maximum sintering temperature (maintenance at maximum temperature) influence the grain growth in the layers in thesintered body and hence the values for the operating voltage $U_A$.

For a more complet understanding of the invention, embodiments of the invention and their mode of operation will now be described in greater detail with reference to the drawing.

Figure 1A:
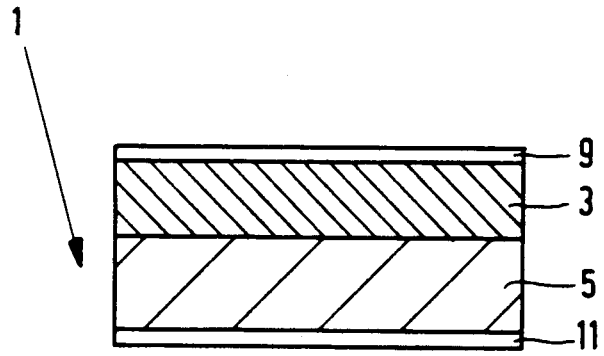
FIG. 1*a* is a cross-sectional view of a multi-layer varistor of the invention.

FIGS. 1*a* and 1*b* show a multi-layer varistor 1 having a layer 3 of a resistance material and a carrier layer 5 (FIG. 1*a*) as well as a coating layer 7 (FIG. 1*b*) and metal layer electrodes 9, 11 of a contact material on the basis of silver. The varistors shown in FIGS. 1*a* and 1*b* are only examples of several possible constructions. Low voltage varistors having good electric properties may also be constructed from a layer structure having a multiplicity of layers 3 of resistive material povided each time with one carrier layer 5 and one coating layer 7; the electrodes 9, 11 are then provided on the lower surface of the carrier layer 5 and on the upper surface of the coating layer 7 (FIG. 1*b*).

As a resistance material (referred to as IV in the following tables) zinc oxide was doped with 0.5 at. % praseodymium, 2 at. % cobalt, 0.5 at. % calcium and 60 ppm aluminum. For that purpose 79.1 g of ZnO, 0.851 g $Pr_6O_{11}$,1.499 g CoO and 0.5 g $CaCO_3$ were mixed in a ball mill with an aqueous solution of 0.023 g of $Al(NO_3)_3.9H_2O$. The slurry was then dried at a temperature of 100° C.

Zinc oxide was doped with 60 ppm aluminum as a material for the carrier layer(s) 5 and the coating layer 7 (referred to as material A in the following tables). For that purpose 81.38 g of ZnO were mixed in a ball mill with an aqueous solution of 0.023 g of $Al(NO_3)_3.9H_2O$. The slurry was then dried at a temperature of 100° C.

Multi-layer varistors were manufactured as follows: the material A and the resistance material IV were combined and sintered together as shown in the diagrammatic FIGS. 1*a* and 1*b*. The following table 1 shows a succession of performed combinations. Accommodation of carrier layer/coating layer and layer of resistance material was carried out as follows:

0.15 g of powder of material A (manufactured according to the above-described example) were packed mechanically in a cylindrical steel matrix having a diameter of 9 mm at a pressure of $1.8\times10^8$ Pa. The resistance material (material IV) (manufactured according to the above-described example) was then stratified on the pre-packed substrate in quantities of 0.025 g to 0.1 g and pressed together with same under a pressure of $1.3\times10^8$ Pa. In the case of the manufacture of three layer varistors (sandwich) again 0.15 g of powder of material A was stratified on the packed layer of resistance material (material IV) and this was pressed on the layer of resistance material (material IV) at a pressure of $8\times10^7$ Pa in the cylindrical matrix.

The compressed green bodies were then sintered in air at temperatures in the range from 1260° to 1300° C. and at maintenance times of a maximum temperature in the range from 0 to 120 minutes with a rate of heating of ≈10° C./min.

The results of the electric measurements are recorded in table 2. The indicated values for the layer thickness relate to the resistance layer.

TABLE 1

| Sample No. | Carrier layer/ coating layer Quant. mat. A. (g) | Resistance layer Quant. mat. IV (g) | Layers (number n) | Sintering temps. (C°) |
|---|---|---|---|---|
| 1 | 0.15* | 0.025 | 2 | 1260 |
| 2 | 0.15* | 0.05 | 2 | 1260 |
| 3 | 0.15* | 0.075 | 2 | 1260 |
| 4 | 0.15* | 0.1 | 2 | 1260 |
| 5 | 2 × 0.15** | 0.05 | 3 | 1285 |
| 6 | 2 × 0.15** | 0.075 | 3 | 1285 |
| 7 | 2 × 0.15** | 0.1 | 3 | 1285 |

*carrier layer only
**carrier layer + coating layer (sandwich).

TABLE 2

| Sample No. (= Tab. 1) | Layers (number n) | Layers thickness (sintered) | Threshold voltage $U_A$ (V) | Non-linearity factor α | Remarks |
|---|---|---|---|---|---|
| Succession of layers of Material A/material IV | | | | | |
| 1 | 2 | 65 | 3–9 | 30–40 | $U_A$ depends on |
| 2 | 2 | 130 | 9–12 | 50–60 | the thickness of |
| 3 | 2 | 195 | 40 | 50–60 | the resistance |
| 4 | 2 | 260 | 80 | 50–60 | layer |
| Succession of layers of material A/material IV/material A (sandwich) | | | | | |
| 5 | 3 | 125 | 3–6 | 40–50 | $U_A$ depends on |
| 6 | 3 | 190 | 9–12 | 50–60 | the thickness of |
| 7 | 3 | 250 | 27–30 | 70–100 | the resistance layer |
| Various sintering temperatures without maintenance time at max. temp. | | | | | |
| 6/1 (1260° C.) | 3 | 190 | 18–20 | 50–60 | $U_A$ dependent on |
| 6/2 (1285° C.) | 3 | 190 | 9–12 | 50–60 | sintering temp. |
| 6/3 (1300° C.) | 3 | 190 | 8–9 | 40–60 | |
| Various maintenance times at sintering temperature 1285° C. | | | | | |
| 6/4 (30 min) | 3 | 190 | 8–9 | 50–70 | $U_A$ depends on |
| 6/5 (45 min) | 3 | 190 | 6–9 | 50–70 | sintering time |
| Various sintering temperatures without maintenance time at max. temp. | | | | | |
| 7/1 (1260° C.) | 3 | 250 | 30–35 | 50–70 | $U_A$ depends on |
| 7/2 (1285° C.) | 3 | 250 | 22–25 | 50–70 | sintering temp. |
| 7/3 (1300° C.) | 3 | 250 | 18–22 | 50–70 | |
| Various maintenance times at sintering temperature 1285° C. | | | | | |
| 7/4 (60 min) | 3 | 250 | 18–22 | 50–70 | $U_A$ depends on |
| 7/5 (120 min) | 3 | 250 | 15–18 | 50–70 | sintering time |

We claim:

1. A non-linear voltage-dependent resistor comprising a ceramic sintered body of at least one laminated structure of a layer (3) of resistance material consisting essentially of zinc oxide doped with at least one alkaline earth metal, at least one rare earth metal and at least one metal of the iron group consisting of aluminum, gallium and indium provided on a carrier layer (5) consisting essentially of zinc oxide and having a higher electric conductivity than the layer (3) of resistance material

2. A voltage-dependent resistor as claimed in claim 1, characterized in that a coating layer (7) based on zinc oxide having a higher electrical conductivity as compared with the resistance material is provided on the layer (3) of resistance material.

3. A non-linear voltage-dependent resistor as claimed in claim 2 characterized in that the resistance material consists of zinc oxide doped with 0.01 to 3.0 at. % praseodymium, 1.0 to 3.0 at. % cobalt 0 to 1.0 at. % calcium and 10 to 100 ppm aluminum.

4. A non-linear voltage-dependent resistor as claimed in claim 3, characterized in that the material consists of zinc oxide doped with 0.5 at. % praseodymium, 2 at. % cobalt, 0.5 at. % calcium and 60 ppm aluminum.

5. A non-linear voltage-dependent resistor as claimed in claim 2, characterized in that the material for the carrier layer(s) (5) and for the coating layer (7) is doped with aluminium.

6. A non-linear voltage-dependent resistor as claimed in claim 5, characterized in that the material for the carrier layer(s) (5) and the coating layer (7) is doped with 30 to 100 ppm aluminum.

7. A non-linear voltage-dependent resistor as claimed in claim 6, characterized in that the material for the carrier layer(s) (5) and the coating layer (7) is doped with 60 ppm aluminum.

8. A non-linear voltage-dependent resistor as claimed in claim 2, characterized in that the electrodes (9, 11) are provided as laminar electrodes.

9. A non-linear voltage-dependent resistor as claimed in claim 8, characterized in that the electrodes (9, 11) consist predominantly of silver.

10. A non-linear voltage-dependent resistor as claimed claim 2, characterized in that the layer(s) (3) of resistance material has (have) a thickness in the range from 65 to 250 μm.

11. A non-linear voltage-dependent resistor as claimed claim 2, characterized in that the carrier layer(s) (5) and the coating layer (7) each have a thickness in the range from 250 to 600 μm.

12. A method for manufacturing the resistor as claimed in claim 2 characterized in that dry powder mixtures of the resistance material and of the material for the carrier layer(s) (5) and the coating layer (7) are manufactured and these powder mixtures are packed and deformed in a matrix by pressure in accordance with the desired layer structure and the desired layer thickness in such a manner that the powder mixtures individually are each packed and deformed successively in layers in accordance with the layers to be manufactured.

13. A method as claimed in claim 12, characterized in that the layers of the powder mixtures are packed at a pressure in the range from $8\times10^7$ to $1.8\times10^8$ Pa.

14. A method as claimed in claim 12, characterized in that green bodies are compressed from the powder mixtures are sintered at a temperature in the range from 1260 to 1300° C. in air with a heating rate of $\approx$10° C. per minute.

15. A method as claimed in claim 14, characterized in that the sintering of the green body is carried out so that the maximum sintering temperature is maintained for 0 to 240 minutes before the cooling process is started.

16. A method as claimed in claim 12, characterized in that the layer(s) (3) of resistance material is (are) manufactured in a thickness in the range from 12 to 250 μm.

17. A method as claimed in claim 12, characterized in that the carrier layer(s) (5) and the coating layer (7) is (are) manufactured in a thickness in the range from 250 to 600 μm.

18. A method as claimed in claim 12, characterized in that metal layer electrodes (9, 11) are provided on the oppositely located major surfaces of the sintered body (1).

19. A method as claimed in claim 18, characterized in that a contact material on the basis of silver is used for the electrodes (9, 11).

* * * * *